United States Patent [19]

Misumi

[11] Patent Number: 4,636,681

[45] Date of Patent: Jan. 13, 1987

[54] DIRECTLY HEATED CATHODE

[75] Inventor: Akira Misumi, Mobara, Japan

[73] Assignee: Hitachi, Ltd., Tokyo, Japan

[21] Appl. No.: 219,941

[22] Filed: Dec. 24, 1980

Related U.S. Application Data

[63] Continuation of Ser. No. 928,733, Jul. 27, 1978, abandoned.

[51] Int. Cl.[4] ..... H01J 1/14; H01J 19/06; H01K 1/04

[52] U.S. Cl. ..... 313/346 R; 313/346 DC; 313/311

[58] Field of Search ..... 428/551, 553, 554; 75/246, 248; 313/345, 346 R, 346 DC, 311

[56] References Cited

U.S. PATENT DOCUMENTS

| | | | |
|---|---|---|---|
| 3,240,569 | 3/1966 | Buescher | 313/346 R |
| 4,081,713 | 3/1978 | Misumi | 313/346 R |
| 4,129,801 | 12/1978 | Soeno et al. | 313/346 R |

*Primary Examiner*—Saxfield Chatmon
*Attorney, Agent, or Firm*—Antonelli, Terry & Wands

[57] ABSTRACT

In a directly heated cathode including a base formed of an alloy containing nickel as its principal component and coated with an oxide of an alkaline earth metal which emits electrons, a layer of a metal selected from the group consisting of nickel, cobalt, platinum and rhodium or of an alloy containing one of these metals as its principal component is formed on both surfaces of the base to one of which surfaces the coating of the oxide is applied, so as to thereby prevent the peeling-off of the coating of the oxide from the base. In order to avoid deformation of the base, a powder alloy containing tungsten and nickel as its principal components, a powder alloy containing molybdenum and nickel as its principal components or one of these powder alloys which is coated with nickel, cobalt or a cobalt-nickel alloy is deposited on the surface of the base to which the coating of the oxide is applied.

16 Claims, 10 Drawing Figures

DIRECTLY HEATED CATHODE

This is a continuation of application Ser. No. 928,733, filed July 27, 1978 and now abandoned.

BACKGROUND OF THE INVENTION

This invention relates to directly heated oxide cathodes and more particularly to surface treatment of a base of a cathode which is coated with an oxide of an alkaline earth metal.

Generally, cathodes are used with receiving tubes, discharge tubes and cathode-ray tubes. A cathode used with a cathode-ray tube should meet the requirement that it acts quickly to instantaneously show a television picture on a screen. That is, a cathode is required to have a short starting time.

There are two types of cathode. One is of an indirectly heated type and the other is of a directly heated type. An indirectly heated cathode has a starting time of about 20 seconds, but a directly heated cathode is very short in its starting time which is 1 to 2 seconds. Owing to this feature, a directly heated cathode is best suited for use as a quick action cathode.

FIG. 1 shows the essential portions, in an enlarged view, of a directly heated cathode of the prior art. In the figure, 1 designates a base to which an electric current is passed to generate heat. The base 1 is formed of a nickel-base alloy comprising tungsten for increasing mechanical strength and magnesium, zirconium, silicon and aluminum serving as reducing agents, with the amount of tungsten usually being 20 to 30% by weight.

2 designates an oxide of an alkaline earth metal with which the base 1 is coated. Generally, in coating the base 1 with the oxide 2, a carbonate of an alkaline earth metal is applied to the base 1 and then the carbonate is subjected to decomposition by heating in a vacuum into an oxide of an alkaline earth metal. When the carbonate is subjected to decomposition by heating, reactions indicated by the following chemical formulae (1), (2), (3) and (4) take place. The following description will refer to an example in which $BaCO_3$ is used as a carbonate and the base 1 is formed of a nickel base alloy containing tungsten.

$$BaCO_3 \rightarrow BaO + CO_2 \uparrow \quad (1)$$

$$3BaCO_3 + W \rightarrow Ba_3WO_6 + 3CO \uparrow \quad (2)$$

$$3BaO + WO_3 \rightarrow Ba_3WO_6 \uparrow \quad (3)$$

$$6BaO + W \rightarrow Ba_3WO_6 + 3Ba \uparrow \quad (4)$$

As is clear in formula (1), $BaCO_3$ is decomposed into the oxide 2 in the form of BaO and $CO_2$, so that it is possible to obtain an electron emitting oxide. However, as is clear in formulae (2), (3) and (4), a layer 5 of $Ba_3WO_6$ is formed and interposed between the base 1 and the oxide 2 as shown in FIG. 2. Because of the presence of the layer 5, operation of the cathode for a prolonged period of time has resulted in the peeling-off of the oxide 2 from the base 1. Thus the cathode of the prior art has had the disadvantage of being short in service life.

In order to eliminate the defect of the cathode shown in FIG. 1, proposals have been made to use a cathode shown in FIG. 3. In FIG. 3, 1 designates a base formed of a nickel-base alloy containing tungsten as is the case with the cathode shown in FIG. 1, and 2 designates a coating of an oxide of an alkaline earth metal, emitting electrons, which is applied to the base 1. An upper surface of the base 1 is coarsened by a powder alloy 3, mainly consisting of nickel and having a particle size of several $\mu$m, which is sprayed onto the upper surface in an amount of several mg per 1 $cm^2$ of the upper surface and fired in a vacuum or hydrogen atmosphere. The oxide 2 is rigidly secured to the base 1 through the medium of the powder alloy 3. In a directly heated cathode of the aforesaid construction, the velocity of diffusion of nickel alloy in powder form through the base 1 increases as heat is generated in the base 1, with the result that the surface of the base 1 which is in contact with the powder nickel alloy 3 is distorted and the base 1 is deformed into a spherical shape. As shown in FIG. 4, the inverse number of a curvature R of the deformation becomes greater as the period of time in which the cathode is placed in service becomes longer. In the diagram shown in FIG. 4, the abscissa indicates the time and the ordinate represents the inverse number of the curvature R showing the amount of deformation. A curve A is obtained when the base has a temperature of 950° C.; a curve B, when the base has a temperature of 1000° C.; and a curve C, when the base has a temperature of 1050° C. The deformation of the base 1 causes a gradual change in the spacing between the oxide 2 and a grid, resulting in changes in cut-off voltage. FIG. 5 shows changes of cut-off voltage, $\Delta Eco$, during operation of the cathode shown in FIG. 3. Thus, if this cathode is used to provide an electron gun structure for a color television cathode-ray tube, the changes would cause the changes of operating point of the three electron guns, so that the electron guns would have the disadvantage that white balance is lost. An additional disadvantage is that, with an increase in the deformation of the base 1, the oxide 2 would peel off the base 1.

As aforesaid, a directly heated cathode of the prior art has the disadvantage that the formation of $Ba_3WO_6$ tends to cause the oxide to be peeled off from the base. If a powder of nickel is deposited on the base by firing as shown in FIG. 3 in order to prevent the peeling off of the oxide from the base, the cathode would undergo a deformation and the movement of the operating point of the electron gun structure would occur, with the result that the cathode is unable to perform its function satisfactorily. Thus the present invention has been developed for the purpose of providing a directly heated cathode which obviates the aforementioned disadvantages of the prior art and which can be put to practical use with satisfactory results.

SUMMARY OF THE INVENTION

A first object of the present invention is to prevent the formation of an intermediate product between a base and an oxide of an alkaline earth metal of a directly heated cathode, so as to thereby avoid the peeling off of the oxide of the alkaline earth metal from the base.

A second object is to prevent the deformation of a base of a directly heated cathode, thereby eliminating the disadvantages of the prior art that changes are caused to occur in the operating point of an electron gun structure for color television and that the oxide tends to be peeled off from the base of the cathode.

A still another object is to prevent the formation of an intermediate product around metal powder interposed between a base and an oxide of an alkaline earth metal of a directly heated cathode for rigidly securing the oxide of the alkaline earth metal to the base, thereby avoiding the peeling off of the oxide of the alkaline earth metal from the base.

In order to accomplish the aforesaid objects, the invention provides a directly heated cathode characterized by comprising a layer, located on both surfaces of the base coated with the oxide, which is formed of a metal selected from the group consisting of nickel, cobalt, platinum and rhodium, an alloy of one of these metals, or an alloy containing these metals as its principal components.

The directly heated cathode provided by the invention has another feature that a powder alloy containing tungsten and nickel as its principal components is deposited on the surface of the base to which the coating of the oxide is applied.

The directly heated cathode provided by the invention has still another feature that a powder alloy containing molybdenum and nickel as its principal components is deposited on the surface of the base to which the coating of the oxide is applied.

The directly heated cathode provided by the invention has a further feature that a powder alloy containing nickel and tungsten; or nickel and molybdenum; or nickel, tungsten and molybdenum as its principal components and coated with nickel, or cobalt, or a nickel-cobalt alloy is deposited on the surface of the base to which the coating of the oxide is applied.

BRIEF DESCRPTION OF THE DRAWINGS

DESCRIPTION OF THE PREFERRED EMBODIMENTS

Figure 1:
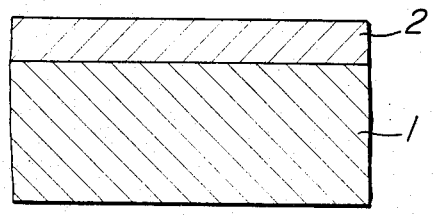
FIG. 1 PRIOR ART
FIGS. 1 and 2 are sectional views showing one example of the directly heated cathode of the prior art.
Figure 2:
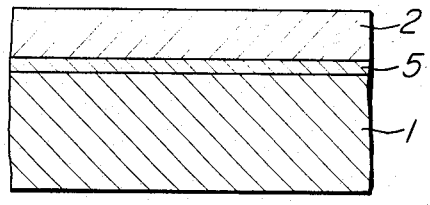
FIG. 2 PRIOR ART
Figure 6:
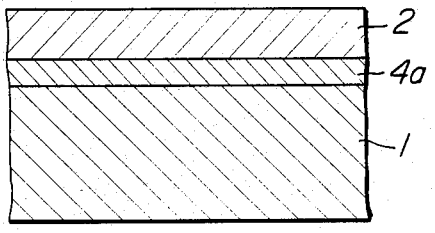
FIGS. 6 and 7 are sectional views showing the directly heated cathode comprising a first embodiment of the invention.
Figure 7:
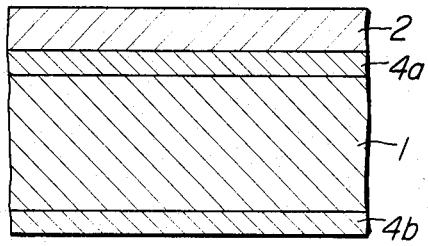

FIGS. 6 and 7 show, in a sectional view, a first embodiment of the invention in which parts similar to those shown in FIG. 1 are designated by like reference characters. In FIGS. 6 and 7, the base 1 is formed of an alloy consisting of 20 to 30% by weight of tungsten, up to 0.5% by weight of reducing agents such as magnesium, zirconium, silicon and aluminum, and the balance nickel. 4*a* is an alloy layer, formed on a surface of the base 1 to which the coating of oxide 2 is applied, which is an alloy containing nickel as its principal component, such as a nickel-cobalt alloy. In this type of cathode, when a carbonate of an alkaline earth metal is applied to the alloy layer 4*a* containing nickel as its principal component and subjected to decomposition by heating in a vacuum, the presence of the alloy layer 4*a* has the effect of inhibiting the chemical reaction indicated by formulas (2) and (3) and of reducing the magnitude of the chemical reaction indicated by formula (4). The result of this is a marked reduction in the amount of $Ba_3WO_6$ which is produced and forms the layer 5. This increases the bond strength of the oxide 2 which becomes difficult to be peeled off from the base. Thus the reliability of the cathode is increased.

However, if the alloy layer 4*a* containing nickel as its principal component is formed on one surface of the base 1, stresses are produced in the base 1, causing deformation of the base 1. The occurrence of this deformation causes a change to occur in the spacing between the oxide 2 and a grid of an electron gun structure, not shown, with the result that a change occurs in cut-off voltage. This has the disadvantage that, in color television cathode-ray tubes, white balance is lost. To eliminate this disadvantage, an alloy layer containing nickel as its principal component and having a thickness of 0.1 to 2.0 μm is formed on both surfaces of the base 1 in the first embodiment as shown in FIG. 7. The alloy layers 4*a* and 4*b* are formed on opposite surfaces of the base 1, as shown. As a result, stresses are produced evenly on opposite surfaces of the base 1 and balance is maintained therebetween, thereby avoiding deformation of the base 1.

The material applied to opposite surfaces of the base 1 to form the layers 4*a* and 4*b* may be a nickel-molybdenum layer containing nickel as its principal component or may be of nickel alone. Alternatively, it may be a metal selected from the group consisting of nickel, cobalt, platinum and rhodium. Any material mentioned hereinabove may be used so long as the production of $Ba_3WO_6$ can be inhibited.

The layers 4*a* and 4*b* may be formed either by plating or by means of electrophoresis.

As aforesaid, in the first embodiment of the invention, a layer of an alloy containing nickel as its principal component, such as a nickel-cobalt alloy, or a metal selected from the group consisting of nickel, cobalt, platinum and rhodium is formed on a first surface of the base 1, containing at least tungsten, to which the oxide coating 2 is applied and on a second surface of the base 1 which is opposite the first surface thereof. By this arrangement, the production of a tungsten base intermediate product, which is formed when a carbonate of an alkaline earth metal is subjected to decomposition by heating, can be inhibited. Thus it is possible to avoid peeling off of the oxide coating from the base and to avoid deformation of the base. The embodiment has the effect of providing a directly heated cathode of high reliability in performance.

Figure 8:
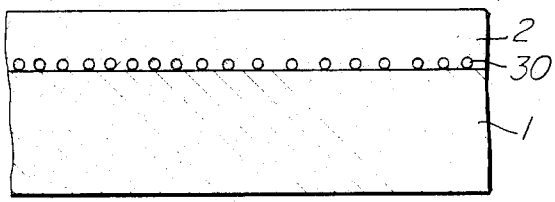
FIG. 8 is a sectional view showing the directly heated cathode comprising a second embodiment of the invention.

FIG. 8 shows, in a sectional view, a second embodiment of the directly heated cathode in confirmity with the invention. In this figure, parts similar to those shown in FIG. 7 are designated by like reference characters. 30 designates a powder alloy deposited on a first surface of the base 1 to which the oxide coating 2 is applied. The powder alloy 30 is deposited on the first surface of the base 1 by being subjected to decomposition by heating in a vacuum. The base 1 is formed of a nickel alloy comprising 20 to 30% by weight of tungsten, and/or molydbenum which is added with up to 0.5% of reducing agents, such as magnesium, zirconium, silicon and aluminum. The powder alloy 30 is a nickel base alloy comprising 20 to 30% by weight of tungsten. The powder alloy 30 is deposited on the first surface of the base 1 by first applying same to the base 1 by printing, spraying or electrophoresis and then subjecting same to sintering.

By this arrangement, diffusion of metals can be balanced between the base 1 and the powder alloy 30. Thus selective transfer of either nickel or tungsten to either the base 1 or the powder alloy 30 can be prevented. Consequently, no distortion of the surfaces of the base 1 occurs due to changes in composition or mass. Therefore, deformation of the base 1 can be avoided.

Practically, in the second embodiment of the invention, the powder alloy 30 deposited on the first surface of the base 1 to which the oxide coating 2 is applied is not required to have the same composition as the alloy forming the base. A slight difference in composition between them is tolerated. The amount of tungsten contained in the alloy forming the base 1 is usually in the range between 20 and 30% by weight, so that it is proper that the amount of tungsten contained in the powder alloy 30 to be deposited on the base 1 be in the range between 20 and 30% by weight.

The second embodiment has been described by referring to the base 1 formed of an alloy comprising nickel and 20 to 30% by weight tungsten as its principal components. It is to be understood that the alloy for forming the base 1 is not limited to the aforesaid composition, and that an alloy comprising nickel and 10 to 30% by weight of molybdenum or an alloy containing nickel and 20 to 30% by weight, in total, of molybdenum and tungsten as its principal components may be used.

As aforesaid, in the second embodiment of the invention, a powder alloy of the nickel base containing tungsten is deposited on the first surface of a base, formed of a nickel base alloy containing tungsten, to which an oxide coating is applied. As a result, equilibrium can be obtained in the diffusion of metals between the base and the powder alloy, so that little or no distortion occurs in the base. Thus the cathode undergoes no deformation, and the disadvantage of the peeling off of the oxide coating from the base can be eliminated.

Figure 3:
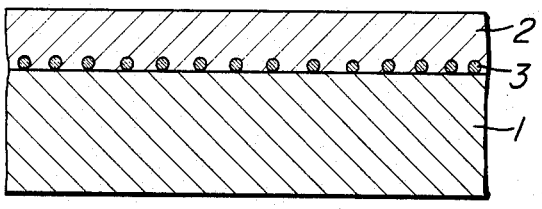
FIG. 3 PRIOR ART
FIG. 3 is a sectional view showing another example of the directly heated cathode of the prior art.
Figure 4:
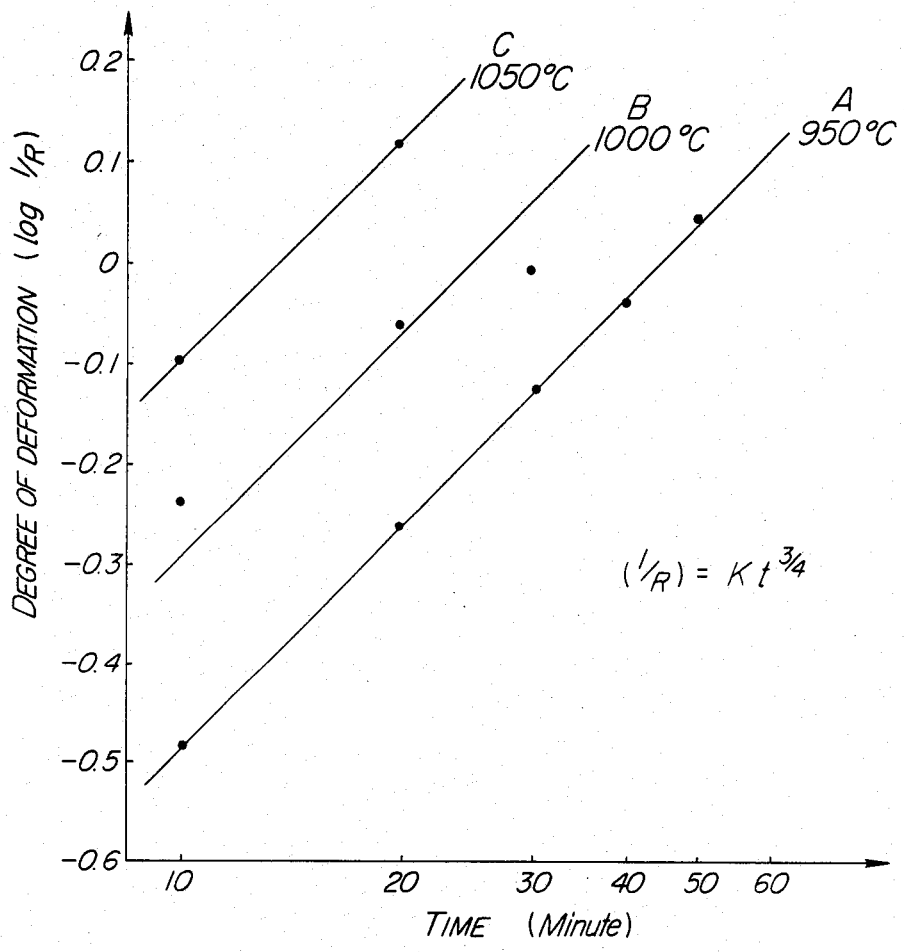
FIG. 4 is a diagrammatic representation of the amount of deformation of the base of a directly heated cathode of the prior art in relation to the time elapsing after the cathode is placed in service.
Figure 5:
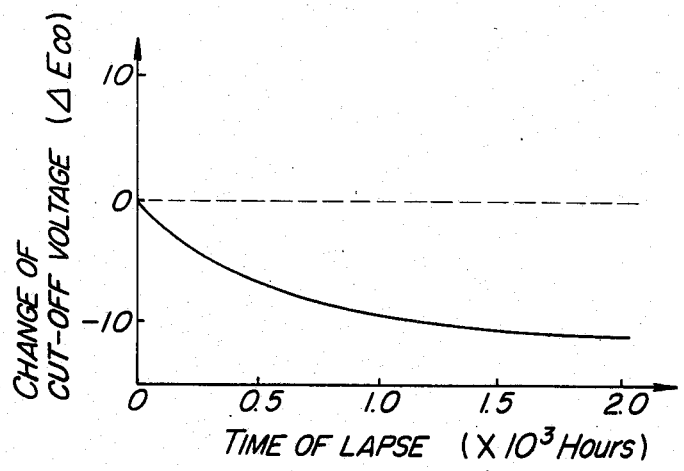
FIG. 5 is a diagrammatic representation of a change in cut-off voltage in relation to the time elapsing after a conventional directly heated cathode is placed in service.

In the second embodiment of the invention, the powder alloy has a particle size of several $\mu$m and several mg of the powder alloy is sprayed onto the base per 1 $cm^2$ of the latter, as is the case with the prior art example shown in FIG. 3.

Figure 9:
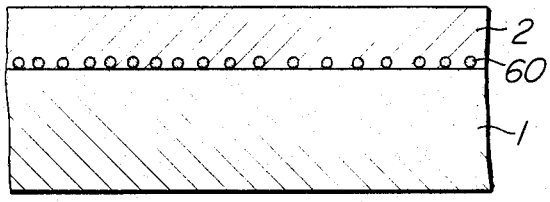
FIG. 9 is a sectional view showing the directly heated cathode comprising a third embodiment of the invention.

FIG. 9 shows a third embodiment of the directly heated cathode in conformity with the invention, and in the figure parts similar to those shown in FIG. 8 are designated by like reference characters. As can be clearly seen in FIG. 9, in this embodiment, a powder alloy 60 comprising nickel and 10 to 30% by weight of molybdenum as its principal components is deposited on a first surface of the base 1, formed of an alloy comprising tungsten and/or molybdenum and nickel as its principal components, to which the oxide coating 2 is applied. The depositing of the powder alloy in this embodiment is carried out under the same condition as described with reference to the second embodiment of the invention.

In the cathode constructed as aforesaid, when the powder alloy is deposited on the first surface of the base 1 and then a carbonate of an alkaline earth metal is applied to the first surface of the base 1 and subjected to decomposition by heating, the following reactions take place:

$$BaCO_3 \rightarrow BaO + CO_2 \uparrow \quad (5)$$

$$3BaCO_3 + Mo \rightarrow Ba_3MoO_6 + 3CO \uparrow \quad (6)$$

$$3BaO + MoO_3 \rightarrow Ba_3MoO_6 \uparrow \quad (7)$$

$$6BaO + Mo \rightarrow Ba_3MoO_6 + 3Ba \uparrow \quad (8)$$

In this embodiment, it has been ascertained that the amount of $Ba_3MoO_6$ produced is very small, with the result that the bond strength of the oxide coating 2 with respect to the base 1 is increased in the order of ten times as high as in a cathode of the prior art. Consequently, the oxide coating 2 is not readily stripped off the base 1 in this embodiment, and the service life of the cathode is lengthened. Additionally, the powder alloy 60 has been found to have the effect of avoiding deformation of the base 1.

Figure 10:
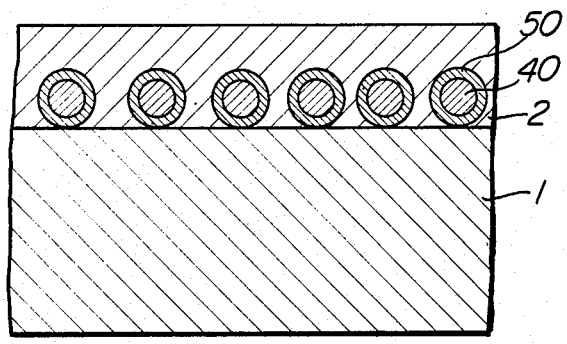
FIG. 10 is a sectional view showing the directly heated cathode comprising a fourth embodiment of the invention.

FIG. 10 shows, in a sectional view, a fourth embodiment of the directly heated cathode in comformity with the invention, and in the figure parts similar to those shown in FIG. 8 are designated by like reference characters. In the figure, 40 designates a powder alloy deposited on a first surface of the base 1 to which the oxide coating 2 is applied. After being applied to the first surface of the base 1, the powder alloy 40 is fired and secured to the base 1. In this embodiment, the base 1 is formed of a nickel alloy of a composition comprising 20 to 30% by weight of tungsten, and/or molybdenum which is added with up to 0.5% by weight of reducing agents, such as magnesium, zirconium, silicon and aluminum. The powder alloy 40 may be a nickel-base alloy containing 20 to 30% by weight of tungsten, a nickel-base alloy containing 10 to 30% by weight of molybdenum, or a nickel-base alloy containing 10 to 30% by weight, in total, of tungsten and molybdenum. The powder alloy 40 is coated with a thin layer of nickel or cobalt or an alloy thereof. The powder alloy 40 is applied to the surface of the base 1 as by printing, spraying or electrophoresis and then sintered to be rigidly secured thereto. The powder alloy 40 is deposited on the base 1 under the same condition as described with reference to the second embodiment.

By virtue of this arrangement, equilibrium can be obtained in the diffusion of the metals to and from the base 1 and the powder alloy 40, and no selective transfer of nickel, tungsten or molybdenum takes place between the base 1 and the powder alloy 40. As a result, no distortion due to changes in composition or mass occurs in the surfaces of the base, thereby avoiding deformation of the base 1.

As aforesaid, the powder alloy 40 is coated with nickel or cobalt or an alloy thereof. Because of the presence of this coating, the temperature at which the powder alloy is sintered in depositing the powder alloy 40 on the surface of the base 1 may be in the range between 800° and 900° C. which is lower than 1000° C. at which the powder alloy must be sintered when no coating is present. A lower sintering temperature reduces the amounts of magnesium, zirconium, silicon and aluminum contained in the base 1 which are spent by oxidation during the process of sintering the powder alloy 40. This results in improved electron emitting capability of the cathode. Also, deformation of the cathode which might occur while the powder alloy is being deposited by sintering and the deformation of the cathode which might occur while being handled after heating can be avoided by lowering the sintering temperature of alloy powders, so that workability of the cathode is basically increased and the productivity of the cathode is markedly increased. The coating of nickel or cobalt or an alloy thereof provided to the powder alloy has a thickness which is optimally in the range between 0.05 and 1.0 μm. The powder alloy 40 may be coated with a nickelous salt or nickel and heated in a vacuum to be deposited on the base 1.

In coating the powder alloy 40 with a nickelous salt or nickel, the powder alloy 40 may be immersed in an aqueous solution of nickelous salt, the aqueous solution may be agitated and the powder alloy 40 coated with the metal may be taken out to be dried.

The material with which the powder alloy is coated is not limited to nickel and cobalt, and may be selected from the group consisting of nickel, cobalt and materials containing nickel and cobalt.

As described hereinabove, in the fourth embodiment of the directly heated cathode in conformity with the invention, a powder alloy which may be a nickel-tungsten alloy, a nickel-molybdenum alloy or a nickel-tungsten-molybdenum alloy is coated with a nickelous salt, nickel or cobalt, and the coated powder alloy is deposited on a first surface of the base, which is a nickel alloy containing one or both of tungsten and molybdenum, which is coated with an oxide of an alkaline earth metal. Thus equilibrium can be obtained in the diffusion of the metals between the base and the powder alloy, and little or no distortion of the base occurs. As a result the cathode is free from deformation, and the disadvantage of the oxide being peeled off from the base can be obviated. Moreover, the sintering temperature can be lowered, and consequently the amounts of spent reducing agents are reduced and machining of the base can be facilitated.

What is claimed is:

1. A directly heated cathode comprising:

a base formed of a nickel base alloy containing tungsten; and a coating of an oxide of an alkaline earth metal which emits electrons, said coating being applied to a first surface of said base;

wherein the improvement comprises:

said nickel base alloy which forms said base being a nickel base alloy containing 20–30% tungsten and small amounts of reducing agents; and at least two layers formed by plating or electrophoresis and formed of a metal selected from the group consisting of, platinum and rhodium, an alloy of said metal or an alloy containing said metal as its principal component, one of said at least two layers being formed directly on said first surface of said base to which said coating of said oxide is applied, the layers, of the at least two layers, formed on the first surface having said coating of said oxide formed directly thereon, and at least one other layer of said at least two layers being formed on a second surface of said base which is opposite said first surface, said layers formed on the first surface and said at least one other layer each having a thickness of 0.1 to 2.0 μm, whereby said layers formed on the first surface act to inhibit formation of a tungsten base intermediate product and said layers formed on the first surface and the at least one other layer formed on the second surface of the base act to prevent deformation of the cathode.

2. A directly heated cathode comprising:

a base formed of a nickel base alloy containing at least one of tungsten and molybdenum; and a coating of an oxide of an alkaline earth metal which emits electrons, said coating being applied to a first surface of said base; wherein the improvement comprises:

particles of an alloy containing tungsten and nickel as its principal components positioned in contact with said first surface of said base to which said coating of said oxide is applied, said particles having an alloy composition whereby diffusion of nickel or tungsten between said base and said particles is balanced so that selective transfer of either nickel or tungsten to either said particles or said base is substantially prevented.

3. A directly heated cathode as claimed in claim 2, wherein said particles of an alloy are of a composition comprising 20 to 30% by weight of tungsten, and the balance nickel.

4. A directly heated cathode as claimed in claim 3, wherein said base is formed of a nickel alloy comprising 20 to 30% by weight of tungsten, a nickel alloy comprising 10 to 30% by weight of molybdenum, or a nickel alloy comprising 20 to 30% by weight, in total, of molybdenum and tungsten.

5. A directly heated cathode as claimed in claim 3, wherein the particles are formed of an alloy that has approximately the same composition as the alloy from which the base is formed.

6. A directly heated cathode as claimed in claim 2, wherein the particles are formed of an alloy that has approximately the same composition as the alloy from which the base is formed.

7. A directly heated cathode as claimed in claim 3, wherein said base is a nickel base alloy containing 20–30% by weight of tungsten.

8. A directly heated cathode comprising:

a base formed of a nickel base alloy containing at least one of tungsten and molybdenum; and a coating of an oxide of an alkaline earth metal which emits electrons, said coating being applied to a first surface of said base; wherein the improvement comprises:

particles of an alloy containing molybdenum and nickel as its principal components positioned in contact with said first surface of said base to which said coating of said oxide is applied, said particles having an alloy composition whereby diffusion of nickel or molybdenum between said base and said particles is balanced so that selective transfer of either nickel or molybdenum to either said particles or said base is substantially prevented.

9. A directly heated cathode as claimed in claim 8, wherein said particles of an alloy are of a composition comprising 10 to 30% by weight of molybdenum, and the balance nickel.

10. A directly heated cathode comprising:

a base formed of a nickel base alloy containing at least one of tungsten and molybdenum; and a coating of an oxide of an alkaline earth metal which emits electrons, said coating being applied to a first surface of said base; wherein the improvement comprises:

particles of an alloy containing nickel and tungsten, nickel and molybdenum, or nickel, tungsten and molybdenum as its principal components, each particle being provided with a coating of nickel, cobalt or a nickel-cobalt alloy, the coated particles being positioned in contact with said first surface of said base to which said coating of said oxide is applied.

11. A directly heated cathode as claimed in claim 10, wherein said alloy of which said particles are made has a composition whereby diffusion of nickel, tungsten and molybdenum between said base and said particles is balanced so that selective transfer of nickel, tungsten and molybdenum to either said particles or said base is substantially prevented.

12. A directly heated cathode as claimed in claim 10, wherein the material of said coating has a sintering temperature for positioning said coated particles in contact with said first surface that is lower than a sintering temperature for positioning particles if no coating were present, whereby the coated particles can be positioned in contact with said first surface, by sintering, at a lower temperature than the temperature needed to position uncoated particles in contact with said first surface by sintering.

13. A directly heated cathode as claimed in claim 10, wherein said particles of an alloy contain a nickel-base alloy containing 20 to 30% by weight of tungsten, a nickel-base alloy containing 10 to 30% by weight of molybdenum, or a nickel-base alloy containing 10 to 30% by weight, in total, of tungsten and molybdenum.

14. A directly heated cathode as claimed in claim 13, wherein said base is formed of a nickel alloy of a composition comprising 20 to 30% by weight of at least one of tungsten and molybdenum, to which is added up to 0.5% by weight of reducing agents.

15. A directly heated cathode as claimed in claim 10, wherein said nickel base alloy constituting said base comprises 20 to 30% by weight of tungsten.

16. A directly heated cathode as claimed in claim 10, wherein the coating applied to said particles of an alloy has a thickness in the range between 0.05 and 1.0 $\mu$m.

* * * * *